US005361949A

United States Patent [19]

Petrou

[11] Patent Number: 5,361,949

[45] Date of Patent: Nov. 8, 1994

[54] PANTS HANGER WITH PIVOTABLE FINGER ON LOWER BAR

[76] Inventor: Nicoleon Petrou, 1531 W. Tadmar Ave., Anaheim, Calif. 92802

[21] Appl. No.: 32,934

[22] Filed: Mar. 17, 1993

[51] Int. Cl.[5] ..... A47G 25/48

[52] U.S. Cl. ..... 223/96; 223/95; 223/91

[58] Field of Search ..... 223/96, 95, 92, 91, 223/85, 93; D6/326, 327, 315; 211/113

[56] References Cited

U.S. PATENT DOCUMENTS

| | | | |
|---|---|---|---|
| D. 220,891 | 6/1971 | Charak . | |
| D. 229,811 | 1/1974 | Laughton | D6/327 |
| D. 238,539 | 1/1976 | Field et al. . | |
| D. 278,867 | 5/1985 | Tendrup et al. . | |
| D. 285,264 | 8/1986 | Miale . | |
| 641,669 | 1/1900 | Benner et al. | 223/96 |
| 1,027,223 | 5/1912 | Sybenga . | |
| 2,517,336 | 8/1950 | Neal | 223/91 |
| 3,343,734 | 9/1967 | Merriman | 223/96 |
| 3,485,423 | 12/1969 | Wagar | D6/327 |
| 4,565,309 | 1/1986 | Batts et al. . | |
| 4,623,079 | 11/1986 | Tendrup et al. | 223/96 |
| 4,892,237 | 1/1990 | Duester et al. | 223/85 |

*Primary Examiner*—Clifford D. Crowder
*Assistant Examiner*—Bibhu Momanty
*Attorney, Agent, or Firm*—Stroock & Stroock & Lavan

[57] ABSTRACT

A garment hanger includes a hanger body having an upper bar and a lower bar coupled thereto. The upper and lower bars each have upper and lower surfaces, respectively. A hook is coupled to the upper bar for supporting the hanger body. A finger is pivotably joined to the upper surface of the lower bar proximate the lower surface of the upper bar. The finger pivots upwardly towards the lower bar when a garment is supported on the lower bar over the finger to capture the garment therebetween. An extension bar on the upper bar may include arms to releaseably capture and hold the lower bar thereto.

23 Claims, 4 Drawing Sheets

PANTS HANGER WITH PIVOTABLE FINGER ON LOWER BAR

BACKGROUND OF THE INVENTION

The present invention is directed generally to a pants hanger and, in particular, to a garment hanger with a hanger bar for hanging a folded garment, such as a pair of pants or the like, with enhanced holding capabilities.

For almost as long as pants have been worn, bars for suspending such pants most likely have been utilized. The legs of the pants are folded at a portion above the knee and then placed in folded condition over a bar. Pants are often displayed in stores hanging in folded condition above the knees on bars, a plurality of which are provided on display carousels, for example. Pants in folded condition are also suspended individually from separate hangers.

It has been recognized in the art that it is desirable in some fashion to gently hold the pants on the bar to prevent them from falling off during shipping, movement or the like. A simple proposal is found in the 1912 U.S. Pat. No. 1,027,223 which shows trousers being held between upper and lower bars on a hanger which are permanently angled towards one another. The problem with such a construction is that if the garment hanging on the lower bar is heavy enough, it will cause the lower bar to separate from the upper bar thereby substantially diminishing or removing the expected holding power.

Accordingly, it is desired to provide a garment hanger for pants or the like with improved and enhanced holding power. The present invention provides such a design and construction.

SUMMARY OF THE INVENTION

Generally speaking, in accordance with the present invention, a garment hanger for hanging pants or the like is provided. The garment hanger includes a hanger body having an upper bar with a hook, and a lower bar integrally coupled to the upper bar. The upper surface of the lower bar includes a finger having a free end angled towards the lower surface of the upper bar. The pivoting moments are such that when a garment is hung over the lower bar the finger will pivot upwardly to capture the garment between the finger and upper bar.

In a preferred embodiment, the garment hanger is integrally formed from a thermoplastic material. A wedge-shaped slot is provided at the free end of the finger between the upper and lower bars to provide enhanced holding power.

In an alternative embodiment, the upper bar may include an extension having downwardly depending arms which releaseably capture the lower bar. In this embodiment, the hanging garment is also releaseably captured by the arms.

Accordingly, it is an object of the present invention to provide an improved garment hanger for hanging pants and the like.

Another object of the present invention is to provide a pants hanger with enhanced holding power to prevent the pants from slipping off of the hanger.

A still further object of the present invention is to provide a plastic garment hanger specially designed for holding a folded pair of pants or the like which is easy and inexpensive to manufacture, and which may be used for shipping and display purposes.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
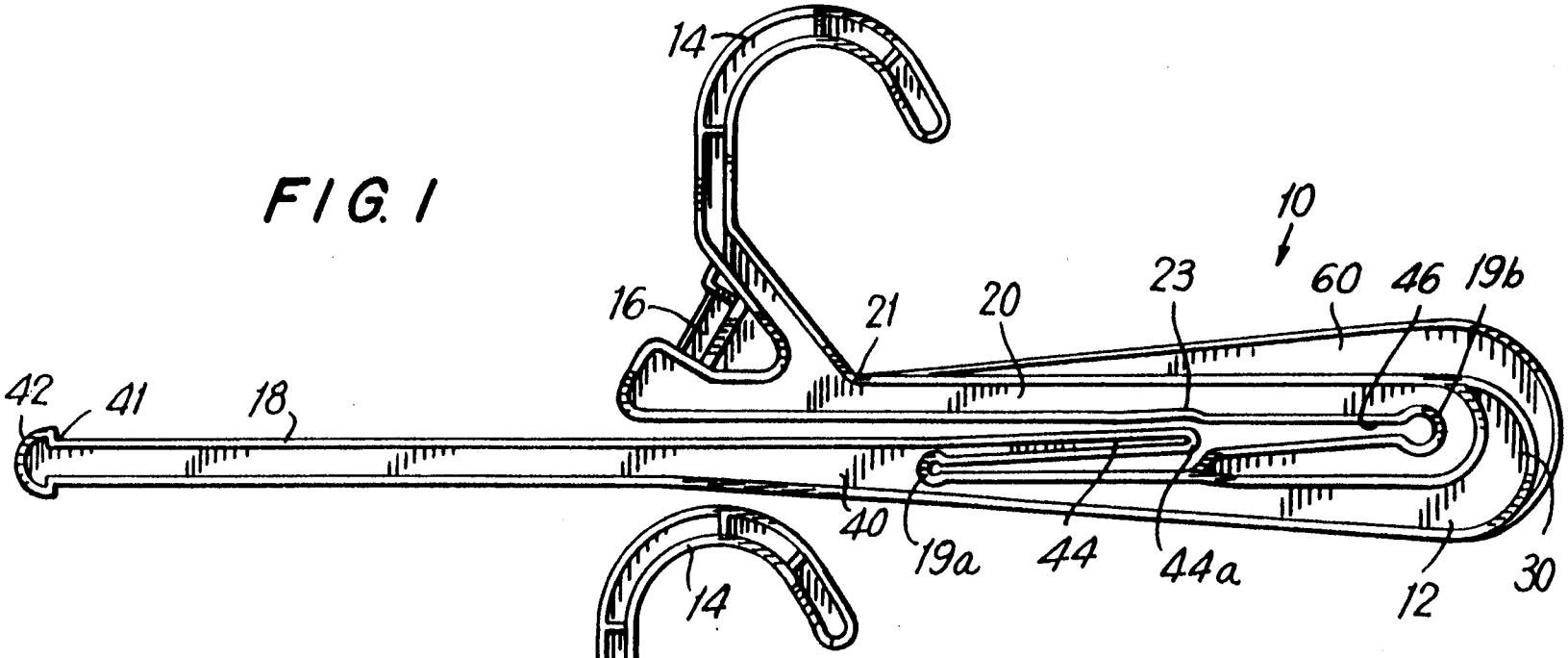
FIG. 1 is an elevational view of a garment hanger constructed in accordance with a preferred embodiment of the present invention.

Reference is first made to FIG. 1 of the drawings which depicts a garment hanger, generally indicated at 10, constructed in accordance with a preferred embodiment of the present invention. Hanger 10 includes an elongated body 12 which includes an upper bar 20 joined to a lower bar 40 by means of a U-shaped member 30. A hook 14 is joined to the free end 21 of upper bar 20 and is used for suspending garment hanger 10 from a rod or the like. As depicted, hook 14 is integrally molded with hanger body 12 and may include a web 16 adapted to receive an information tab or the like such as is disclosed in U.S. Pat. Nos. 4,115,940 and 5,096,101.

Figure 2:
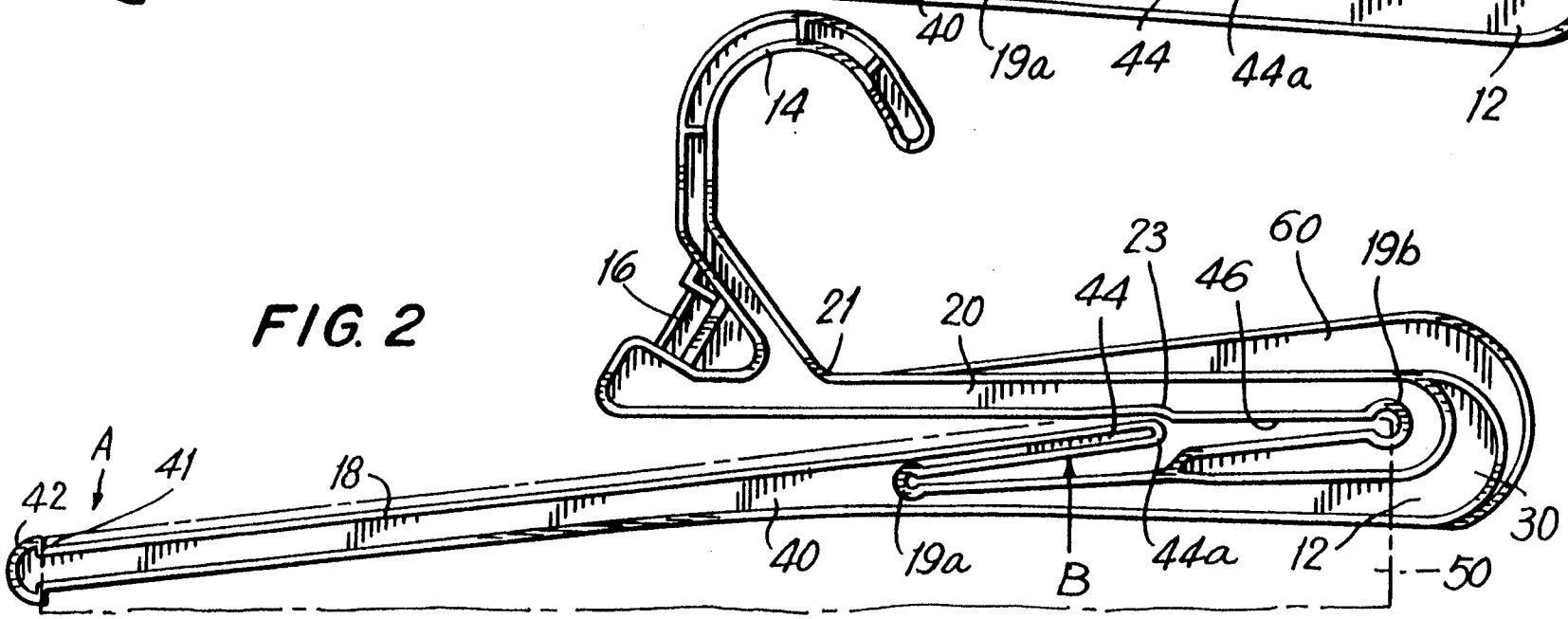
FIG. 2 is an elevational view similar to FIG. 1 but showing a pair of pants, in phantom, hanging from the lower hanger bar of the garment hanger.
Figure 3:
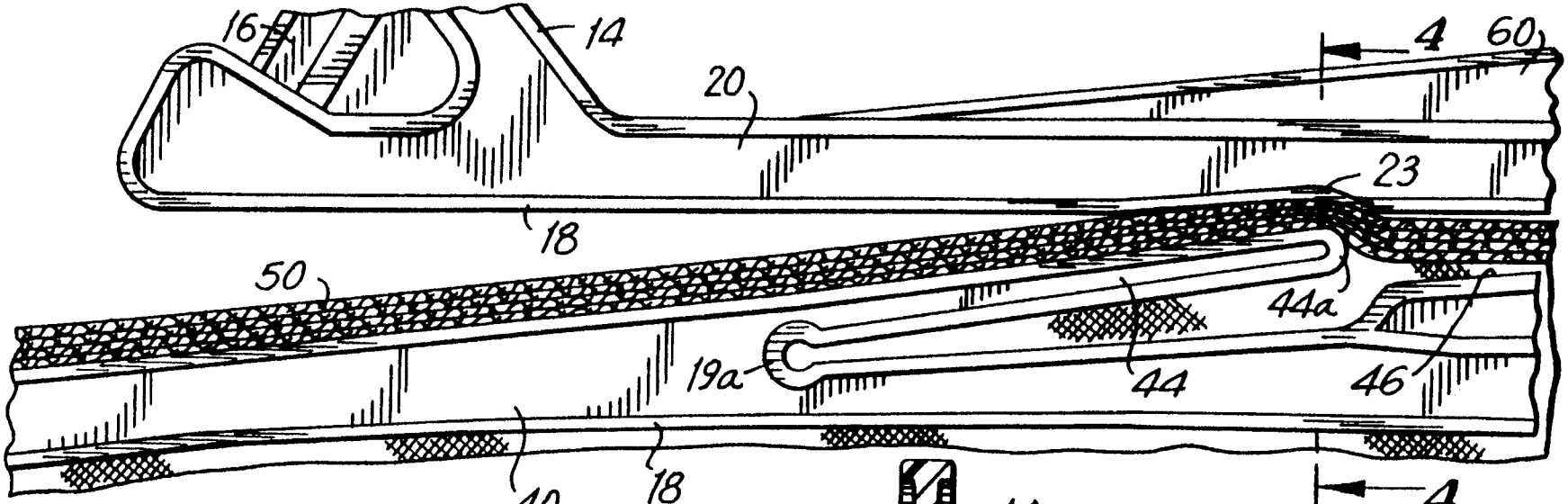
FIG. 3 is an enlarged, detailed elevational view showing in detail one of the locking features of the present construction.
Figure 4:
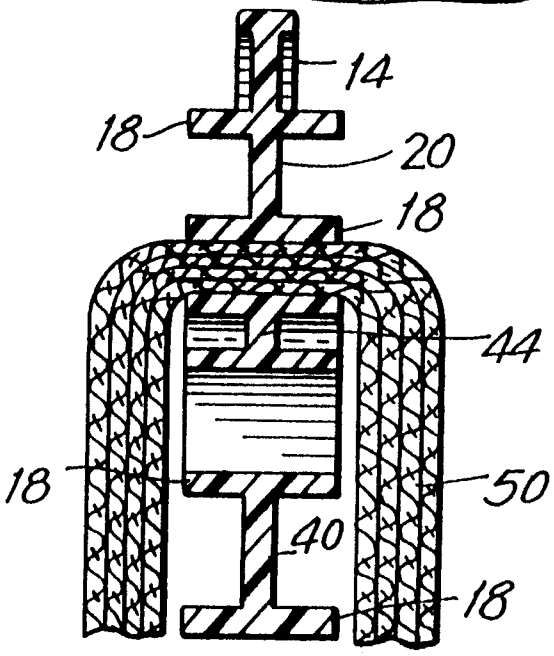
FIG. 4 is a sectional view taken along line 4—4 of FIG. 3.

Referring now additionally to FIGS. 2 through 4, it is seen that upper bar 20 and lower bar 40 lie essentially in the same vertical plane so that when a garment 50 is draped over lower bar 40 the hanger and garment will lie essentially in the same plane.

It is also noted that lower bar 40 is longer than upper bar 20 and extends beyond hook 14 coupled to free end 21 of upper bar 20 to facilitate the insertion and positioning of garment 50 over lower bar 40.

Lower bar 40 includes an inwardly extending finger 44 which projects towards U-shaped hinge 30 and is angled slightly upwardly towards upper bar 20 as depicted in FIG. 1. From the tip or free end 44*a* of finger 44 towards U-shaped hinge 30, a wedge-shaped opening 46 is formed.

Hanger body 12 is of an I-beam construction as best depicted in FIG. 4. The I-beam construction is formed by providing a rigid laterally extending strut 18 which extends around the periphery of hanger body 12 as depicted. Strut 18 also surrounds finger 44 and defines circular pivoting areas 19*a* and 19*b*. It is also noted that free end 41 of lower hanger bar 40 includes a raised projection 42 which assists in positioning garment 50 on lower hanger bar 40.

When a force is exerted on lower hanger bar 40 in the direction of arrow A through the weight of garment 50 positioned thereon, lower hanger bar 40 will pivot downwardly in the direction of arrow A. At the same time, due to the aforenoted and detailed construction, finger 44 will pivot upwardly in the direction of arrow B towards upper hanger bar 20 to effectively grab garment 50 therebetween. Also, due to the wedge shape of slot 46, the portion of garment 50 inserted therein will also act to hold garment 50 on lower hanger bar 40. It is noted that strut 18 is slightly indented at portion 23 of upper hanger bar 20 at the position where the tip 44*a* of finger 44 projects.

An extra web of plastic material 60 is also provided along the upper surface of upper bar 20 and around U-shaped hinge 30 to enhance the pivoting effect of finger 44. Finger 44 is caused to pivot because pivoting point or moment 19*a* is the weakest pivoting point as lower bar 40 is moved downwardly. The hanger tends to flex at pivot point 19*a* causing finger 44 to reach upwardly towards upper bar 20.

Hanger body 12 is preferably molded integrally from a thermoplastic material such as polypropylene, although other plastic materials may be used.

The garment hanger construction of the present invention as described above thus provides a dual locking and holding feature. The first locking feature is in the form of projecting finger 44 and creates tension as soon as the garment is draped over the lower hanger bar. The second locking feature is the wedge-shaped slot at the end of finger 44 into which the end of the garment is placed. The wedge shape further enhances the holding power of the hanger. Finally, projection 42 acts to position, align and further hold the garment on the hanger. The heavier the garment, the more force will be exerted by finger 44.

Figure 5:
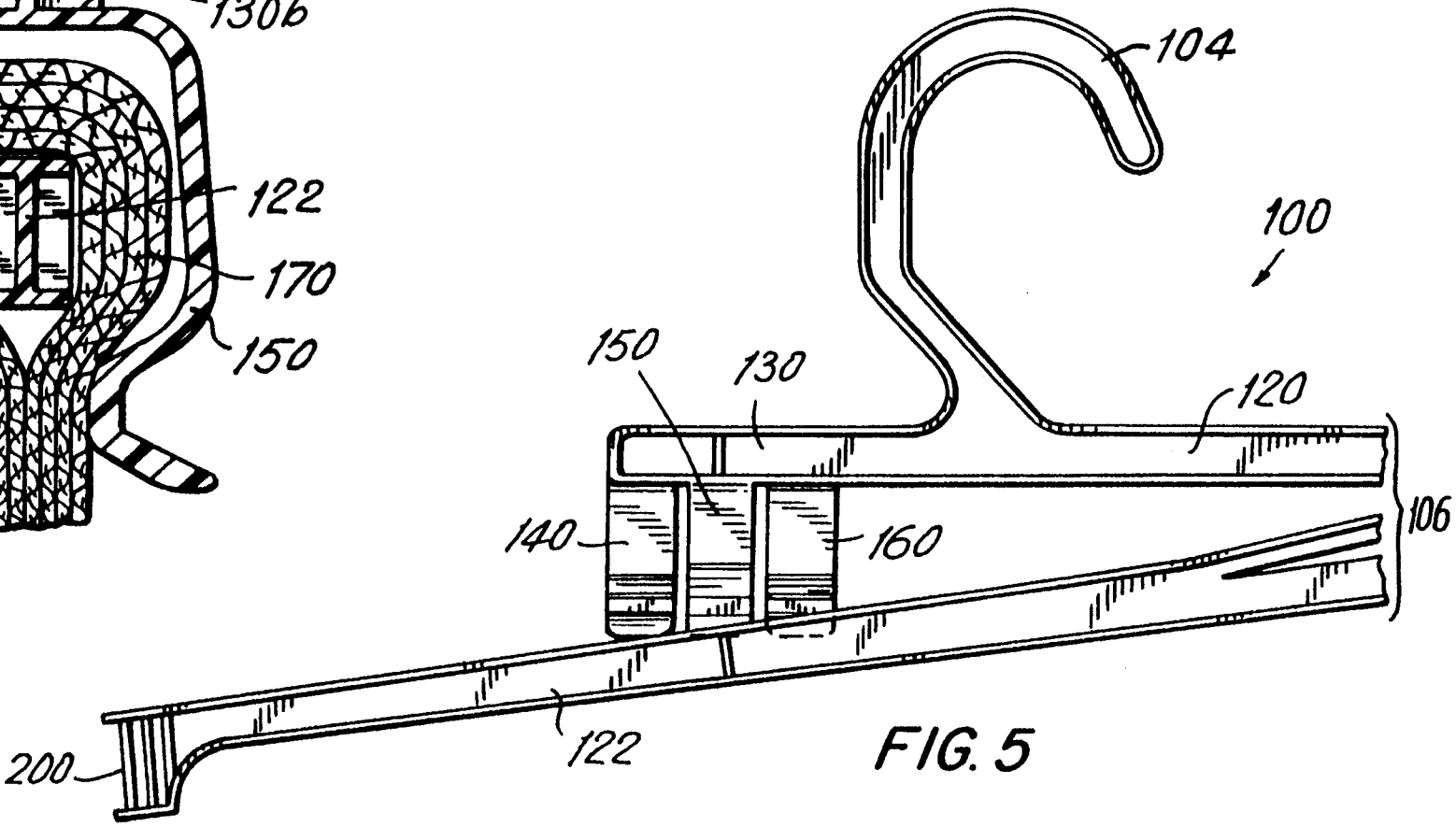
FIG. 5 is a partial perspective view of a garment hanger constructed in accordance with an alternative embodiment of the present invention.
Figure 7:
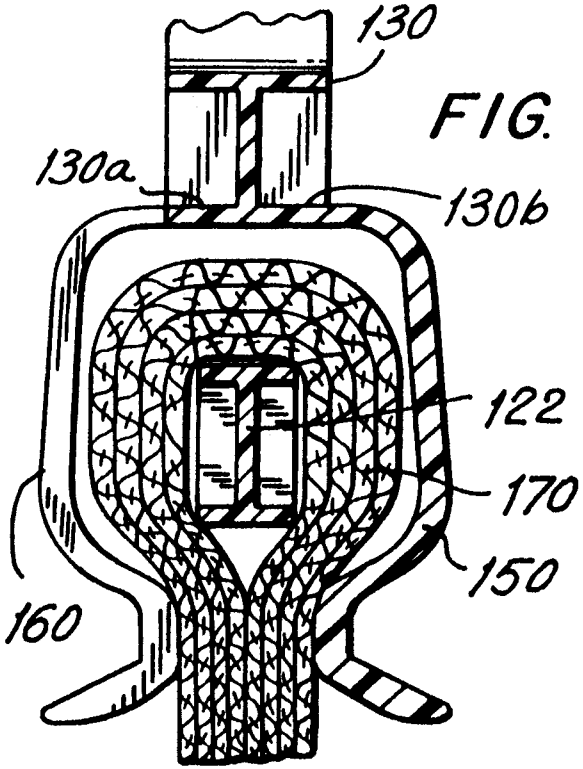
FIG. 7 is an enlarged sectional view taken along line 7—7 of FIG. 6.
Figure 6:
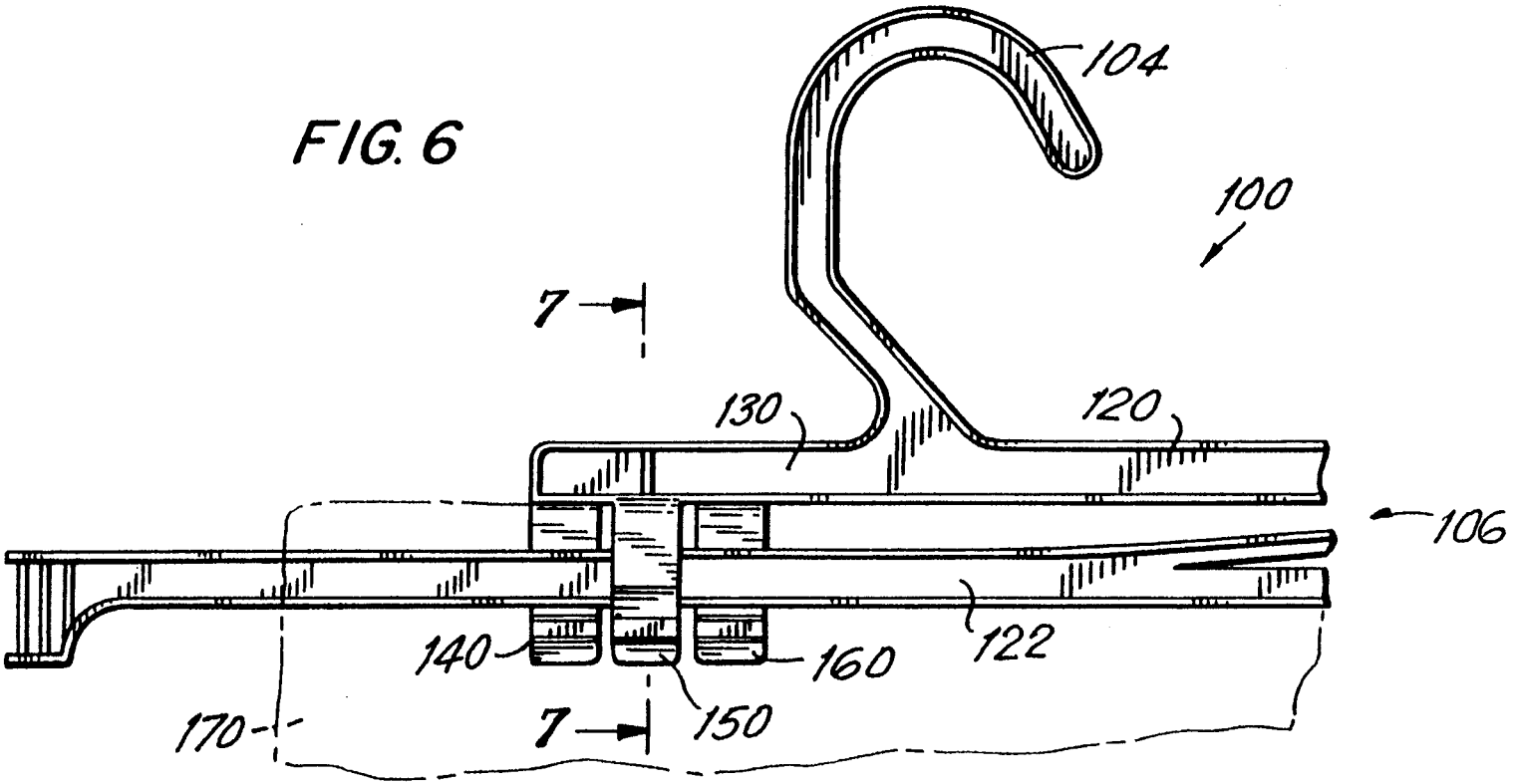
FIG. 6 is a view similar to FIG. 5 but shows the lower bar with a garment thereon in closed position.

Referring now to FIGS. 5 through 7, an alternative embodiment of the present invention will be described. Garment hanger 100 includes a hook 104 and a closed end 106 (shown broken away) which may be constructed in a manner similar to the garment hanger depicted in FIGS. 1–4. However, in garment hanger 100, upper bar 120 includes an extension bar 130 which extends outwardly from the other side of hook 104 as depicted. Extension bar 130 includes downwardly depending spaced arms 140, 150 and 160. Arms 140 and 160 depend from the rear surface 130*a* of extension bar 130. Arm 150 depends from the front surface 130*b* of extension bar 130. In this fashion, arms 140 and 160 are offset from arm 150 to permit lower bar to be releaseably captured therebetween as depicted in FIGS. 6 and 7.

The free ends of arms 140, 150 and 160 are preferably curved inwardly as depicted to provide a more secure holding of lower bar 122 and to provide a snap-locking action. Alternatively, the free ends of the arms may include inwardly facing projections to assist in holding lower bar 122.

One of the benefits of this construction is that in addition to the holding of lower bar 122 to upper bar 120, a garment 170 draped over lower bar 122 will also be releaseably captured by arms 140, 150 and 160 as depicted in FIG. 7. In combination with the holding power of wedge-shaped slot 46 and finger 44 (FIGS. 1–4), the holding power of arms 140, 150 and 160 provide a triple holding system for the garment hanger.

Figure 8:
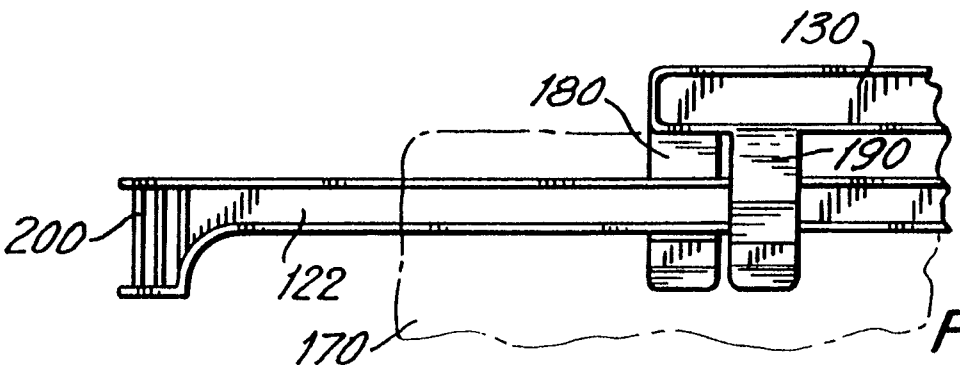
FIG. 8 is a partial perspective view of a garment hanger showing a third embodiment of the present invention.

FIG. 8 depicts an alternative embodiment for the garment hanger where extension bar 130 includes only two arms 180 and 190 with curved ends which face inwardly. Lower bar is captured between arms 180 and 190, as is garment 170.

It is noted that a web 200 is formed at the free end of lower bar 122. Web 200 is adapted to receive an information tab as described above.

The present invention is especially designed for hanging a folded pair of pants or the like by the knees or thigh portions of the pants. It is recognized that the present invention may be used for other garments which may be draped over the lower bar of the garment hanger. It is also recognized that the present garment hanger may be used both for in store displays, and for shipping garments on hangers from the manufacturer to the stores in which the garments will be sold. The present garment hanger is relatively inexpensive and easy to manufacture and may be integrally formed in a mold without the use of pins, ejectors or the like.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A garment hanger comprising a hanger body having an upper bar and a lower bar, and coupling means for joining said lower bar to said upper bar, said upper and lower bars each having upper and lower surfaces, hook means coupled to said upper bar for supporting said hanger body, said lower bar having a free end which extends beyond said hook means, a finger pivotably joined to said upper surface of said lower bar covered by said upper bar and spaced inwardly from the free end of said lower bar, said finger pivoting upwardly towards said lower surface of said upper bar when a garment is supported on said lower bar extends over said finger to capture said garment therebetween.

2. The garment hanger as claimed in claim 1, wherein said finger has a free end pointing towards said coupling means.

3. The garment hanger as claimed in claim 2, wherein a slot having narrower and wider portions is defined intermediate the free end of said finger and said coupling means, a narrower portion of said slot being positioned at said coupling means and a wider portion of said slot being positioned proximate the free end of said finger.

4. The garment hanger as claimed in claim 1, wherein said hanger body is of an I-beam construction and includes a strut extending around the periphery of said hanger body.

5. The garment hanger as claimed in claim 4, wherein said strut defines a pivot point where said finger is attached to said lower bar.

6. The garment hanger as claimed in claim 5, wherein said strut defines a second pivot point where said coupling means joins said lower bar to said upper bar.

7. The garment hanger as claimed in claim 1, wherein said free end of said lower bar includes a projection thereon.

8. The garment hanger as claimed in claim 1, wherein said hanger body is integrally formed from a thermoplastic material.

9. The garment hanger as claimed in claim 8, wherein an additional strip of thermoplastic material extends along the upper surface of said upper bar to said coupling means.

10. The garment hanger as claimed in claim 1, wherein said coupling means is U-shaped and hingedly positions said lower bar below said upper bar.

11. The garment hanger as claimed in claim 2, wherein the lower surface of said upper bar is recessed above said free end of said finger.

12. The garment hanger as claimed in claim 1, wherein said upper and lower bars are positioned in essentially the same plane.

13. A garment hanger comprising a hanger body having an upper bar and a lower bar, and coupling means for joining said lower bar to said upper bar, said upper and lower bars each having upper and lower surfaces, hook means coupled to said upper bar for supporting said hanger body, a finger pivotably joined to said upper surface of said lower bar proximate the lower surface of said upper bar, said finger pivoting upwardly towards said lower surface of said upper bar when a garment is supported on said lower bar and extends over said finger to capture said garment therebetween, said upper bar including an extension bar on opposite side of said hook means, said extension bar including downwardly depending arm means for capturing said lower bar to releaseably hold said lower bar to said upper bar.

14. The garment hanger as claimed in claim 13, wherein said arm means includes at least two arms, said hanger body having a front and a back, one of said arms depending from the front of said body and another of said arms depending from the rear of said body to provide an offset.

15. The garment hanger as claimed in claim 14, wherein said arm means includes first, second and third arms, said first and third arms depending from the front of said body and the second arm depending from the rear of said body.

16. The garment hanger as claimed in claim 14, wherein said at least two arms have free ends which are curved inwardly.

17. A garment hanger comprising a hanger body having an upper bar and a lower bar, a U-shaped member pivotably coupling said lower bar below said upper bar in essentially the same plane, said upper and lower bars defining an elongated slot therebetween having an essentially uniform width for a major extent thereof, said upper and lower bars forming a slot having narrower and wider portions therebetween adjacent said U-shaped member a narrower portion of said slot being positioned at said U-shaped member and a wider portion of said slot being positioned away from said U-shaped member, said slot holding a garment on said lower bar when a garment is supported on said lower bar and extends into said slot, said lower bar including a pivotable finger extending towards said slot and covered by said upper bar, said finger pivoting towards said upper bar when a garment is supported on said lower bar, a wider portion of said slot being positioned proximate said finger.

18. The garment hanger as claimed in claim 17, wherein the pivoting moment of said finger is less than the pivoting moment of said U-shaped member.

19. A garment hanger comprising a hanger body having an upper bar and a lower bar, hook means coupled to said upper bar for supporting said hanger body, a U-shaped member pivotably coupling said lower bar below said upper bar in essentially the same plane, said upper and lower bars defining an elongated slot therebetween having an essentially uniform width for a major extent thereof, said upper and lower bars forming a wedge-shaped slot therebetween adjacent said U-shaped member, said wedge-shaped slot holding a garment on said lower bar when a garment is supported on said lower bar and extends into said slot, said upper bar including an extension bar on the opposite side of said hook means, said extension bar including downwardly depending arm means for capturing said lower bar to releaseably hold said lower bar to said upper bar.

20. The garment hanger as claimed in claim 19, wherein said arm means includes at least two arms, said hanger body having a front and a back, one of said arms depending from the front of said body and another of said arms depending from the rear of said body.

21. A garment hanger comprising a hanger body having an upper bar and a lower bar, and coupling means for joining said lower bar to said upper bar so that said upper and lower bars are essentially parallel, said upper and lower bars each having upper and lower surfaces, hook means coupled to said upper bar for supporting said hanger body, said upper bar including an extension bar on the opposite side of said hook means, said extension bar including downwardly depending arm means for capturing said lower bar to releasably hold said lower bar essentially parallel to said upper bar, said arm means including at least two arms, said hanger body having a front and a back, one of said arms depending from the front of said body and another of said arms depending from the rear of said body.

22. A garment hanger comprising a hanger body having an upper bar and a lower bar, and coupling means for joining said lower bar to said upper bar, said upper and lower bars each having upper and lower surface, hook means coupled to said upper bar for supporting said hanger body, said upper bar including an extension bar on the opposite side of said hook means, said extension bar including downwardly depending arm means for capturing said lower bar to releasably hold said lower bar to said upper bar, said hanger body having a front and a back, said arm means including first, second and third arms, said first and third arms depending from the front of said body and the second arm depending from the rear of said body.

23. The garment hanger as claimed in claim 22, wherein said at least two arms have free ends which are curved inwardly.

* * * * *